United States Patent [19]

Wylie, III

[11] Patent Number: 4,848,193

[45] Date of Patent: Jul. 18, 1989

[54] OPEN-END RATCHET WATCH

[76] Inventor: Albert A. Wylie, III, 39 North Street, Warwick, R.I. 02886

[21] Appl. No.: 185,412

[22] Filed: Apr. 25, 1988

[51] Int. Cl.[4] ..... B25B 13/28

[52] U.S. Cl. ..... 81/111; 81/126

[58] Field of Search ..... 81/111, 106, 109, 92, 81/94, 97, 100, 126, 128, 127, 165, 129

[56] References Cited

U.S. PATENT DOCUMENTS 3,641,847 2/1972 Horton ..... 81/111
3,901,106 8/1975 Causey ..... 81/111

FOREIGN PATENT DOCUMENTS 1403411 10/1968 Fed. Rep. of Germany ..... 81/111

*Primary Examiner*—Debra Meislin
*Attorney, Agent, or Firm*—Salter & Michaelson

[57] ABSTRACT

An open-end ratchet wrench includes a handle element, a first jaw portion which is integrally formed with the handle element, a slide portion, a second jaw portion which is integrally formed with the slide portion, a restricting mechanism and a biasing spring. The slide portion is slidably mounted on the handle element so that the second jaw portion is positionable in a normal position wherein the first and second jaw portions cooperate to define a mouth for receiving the head of a fastening element and the biasing spring biases the second jaw portion toward the normal position thereof. The restricting mechanism maintains the second jaw portion in the normal position thereof when the wrench is manipulated to rotate the head of a fastening element in a first direction so that a turning force is applied to the fastening element. However, the restricting mechansim permits the second jaw portion to be moved outwardly from the first jaw portion when the wrench is rotated in an opposite second direction so that the head of the fastening element can rotate between the first and second jaw portions.

10 Claims, 2 Drawing Sheets

OPEN-END RATCHET WATCH

BACKGROUND AND SUMMARY OF THE INVENTION

The instant invention relates to wrenches and more particularly to an open-end wrench which is operative with an automatic ratcheting action for tightening and loosening hex-headed fastening elements.

Over the years, ratchet wrenches have been found to be extremely effective for tightening and loosening hex-headed fastening elements, such as bolts and machine screws, in a virtually limitless range of applications. In this connection, ratchet wrenches have generally been found to be advantageous from a convenience standpoint, since they do not have to be repositioned on the heads of fastening elements during tightening or loosening operations. Further, ratchet wrenches have been found to be advantageous from a mechanical standpoint, since they permit tightening or loosening operations to be carried out with oscillating motions which generally permit users thereof to apply maximum levels of torque to the heads of fastening elements while nevertheless minimizing the amounts of work required to perform tightening or loosening operations. However, while ratchet-type wrenches have been found to have significant advantages over other types of wrenches, it has been found that they generally require significant amounts of clearance space to enable them to be installed on the heads of fastening elements and thereafter manipulated to rotate the heads of the fastening elements during tightening or loosening operations. In this connection, most of the heretofore available ratchet wrenches have been embodied as either socket-type wrenches or as box-type wrenches, and hence they have required substantial amounts of clearance space around the entire heads of fastening elements on which they are engaged. Further, while attempts have been made to construct ratchet wrenches in other configurations, such as open-end configurations, the only heretofore available open-end type wrenches which have been operative with ratcheting actions have required specific user manipulations to provide simulated ratcheting actions, and they have not been operative with truly automatic ratcheting actions, such as normally found in box or socket-type ratchet wrenches.

Open-end type wrenches which represent the closest prior art to the subject invention of which the applicant is aware are disclosed in the U.S. Pat. Nos. to Pehrsson 2,013,065; Falk 2,302,199; Bugge 2,719,448; Israel 2,827,814; Allegraud 3,232,150; Rydell 3,505,915; Evans 3,817,128; Wilson 3,878,741; and Meggs et al 4,065,986. However, while these references disclose a number of wrenches which are rapidly adjustable for engaging hex-headed fastening elements of different sizes, as well as a number of wrenches which are manually operative for providing simulated ratcheting actions, they fail to disclose or suggest an open-end type wrench which is operative with a truly automatic ratcheting action, and hence they are believed to be of only general interest with respect to the subject invention.

The instant invention provides a highly effective openend type ratchet wrench which is operative with an automatic ratcheting action and which can be utilized for effectively and easily manipulating the heads of hex-headed fastening elements in areas where only limited clearance space is available. More specifically, the instant invention provides a ratchet wrench comprising an elongated handle element and a jaw assembly on the handle element including a first jaw portion which is rigidly attached to the handle element, a slide portion which is slidably mounted on the handle element, and a second jaw portion which is mounted on the slide portion and positionable in a predetermined normal position wherein the first and second jaw portions cooperate to define a mouth therebetween for nonrotatably receiving the head of a hex-headed fastening element. The jaw assembly further includes biasing means for biasing the second jaw portion toward the first jaw portion and also toward the adjacent end of the handle element and restricting means for preventing movement of the second jaw portion beyond the normal position thereof in a direction toward the first jaw portion and also in a direction toward the adjacent end of the handle element. The restricting means is further operative for preventing movement of the second jaw portion beyond the normal position in a direction away from the first jaw portion when the sum of the forces applied to the second jaw portion has a net force component which extends in a direction toward the adjacent end of the handle element. The second jaw portion is, however, otherwise movable in a direction away from both the first jaw portion and the adjacent end of the handle element against the force of the biasing means when the sum of the forces applied to the second jaw portion has a net force component which extends outwardly in a direction away from the adjacent end of the handle element. In this connection, it has been found that the forces which are applied to a wrench by the head of a fastening element during a tightening or a loosening operation inherently cause the second jaw portion to be urged toward the adjacent end of the handle element while turning the fastening element in one direction and away from the handle element while turning the fastening element in the opposite direction. Accordingly, when the wrench is received on the head of a fastening element and the wrench is rotated in a first direction wherein the sum of the forces applied to the second jaw portion has a net force component which extends toward the adjacent end of the handle element, the second jaw portion is prevented from being moved outwardly from the first jaw portion by the restricting means and a turning force is applied to the fastening element. However, when the wrench is rotated in an opposite second direction, the sum of the forces applied to the second jaw portion by the head of the fastening element has a net force component which extends in a direction away from the adjacent end of the handle element so that the second jaw portion can be cammed outwardly away from the first jaw portion by the head of the fastening element to enable the head of the fastening element to rotate between the first and second jaw portions.

In the preferred embodiment of the wrench of the subject invention, the first and second jaw portions have substantially flat faces thereon which are disposed in substantially parallel spaced relation when the second jaw portion is in the normal position thereof, and the faces of the first and second jaw portions are engageable with opposite peripheral portions of the head of a fastening element to cause the second jaw portion and the slide portion to be urged toward the adjacent end of the handle element and to thereby prevent the second jaw portion from being moved outwardly when the wrench is rotated in the first direction. The faces on the first and second jaw portions are also engageable with opposite peripheral portions of the head of a fastening element to cause the second jaw portion to be urged outwardly and away from the adjacent end of the handle element when the wrench is rotated in the second direction. The restricting means preferably comprises track means on one of either the handle element or the slide portion and pin means on the other one of the handle element or the slide portion, and the pin means is received in the track means for guiding and restricting the movement of the slide portion relative to the handle element. The track means preferably comprises an elongated aperture in either the handle element or the slide portion which extends angularly outwardly toward the second jaw portion and away from the first jaw portion and forms a seat at one end thereof, and the pin means preferably comprises a pin element which is mounted on the other end of either the handle element or the slide portion so that it travels in the aperture when the slide portion is moved relative to the handle element. Further, the wrench is preferably adapted so that the pin element is receivable in engagement with the seat for preventing movement of the second jaw portion in a direction away from the first jaw portion, and the restricting means preferably further includes a stop which is engageable with the slide portion for preventing the slide portion from pivoting about the pin element to move the second jaw portion from the first jaw portion when the pin element is received in the seat and the second jaw portion is in the normal position. Accordingly, when the wrench is assembled on the head of a fastening element and turned in the first direction, a net force is applied to the second jaw portion having a component which extends in the direction of the adjacent end of the handle element so that the pin element is urged against the seat to prevent the second jaw portion from being moved outwardly. However, when the wrench is rotated in the opposite second direction, a net force is applied to the second jaw portion having a component which extends in a direction away from the adjacent end of the handle element so that the pin element is disengaged from the seat to enable the second jaw portion to be moved outwardly relative to the first jaw portion and the adjacent end of the handle element. The first and second jaw portions are preferably disposed on opposite sides of a central axis of the jaw assembly, and the aperture is preferably disposed on the same side of the axis as the second jaw portion, whereas the stop is preferably disposed on the same side of the axis as the first jaw portion. The biasing means of the wrench is preferably operative for biasing the slide portion to a position wherein the pin element is received in the seat, and it preferably comprises a spring element which is operative along an axis which is substantially perpendicular to the axis of the jaw assembly. The axis of the spring element is preferably spaced from the stop, and the spring element preferably biases the slide portion toward a position wherein it is pivoted about the pin element so that it engages the stop and so that the pin element is received in engagement with the seat. The first jaw portion preferably has first and second primary faces and first and second secondary faces thereon, and the second jaw portion preferably has third and fourth primary faces and third and fourth secondary faces formed thereon. The primary faces are preferably sequentially disposed at angles of approximately 120° with respect to each other, and the secondary faces are preferably disposed at angles of approximately 120° with respect to each other and approximately 210° with respect to the adjacent primary faces. Accordingly, when the wrench is received on the head of a fastening element so that sequential sides of the fastening element are positioned in engagement with the first, second, third and fourth primary faces and the wrench is rotated in the second direction, the second jaw portion is cammed outwardly so that the sides of the fastening element are moved into engagement with the first, second, third and fourth secondary faces on the wrench.

Accordingly, it is a primary object of the instant invention to provide an open-end type wrench which is operative with an automatic ratcheting action.

Another object of the instant invention is to provide an effective ratchet wrench which can be utilized for manipulating fastening elements located in areas where space limitations prevent the use of other types of ratchet wrenches.

An even further object of the instant invention is to provide an open-end ratchet wrench having a size which is equivalent to that of a conventional open-end wrench.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
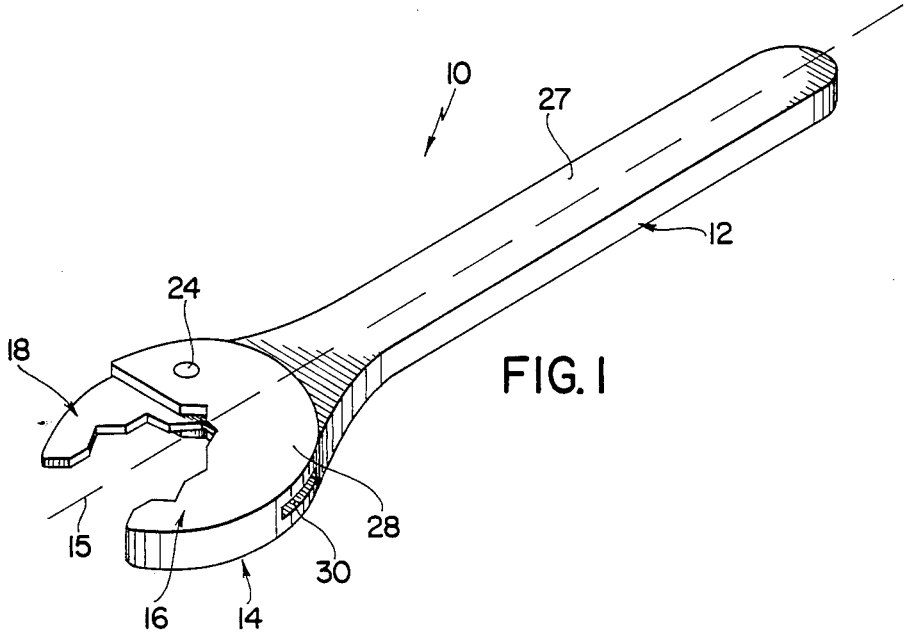
FIG. 1 is a perspective view of the ratchet wrench of the instant invention.
Figure 2:
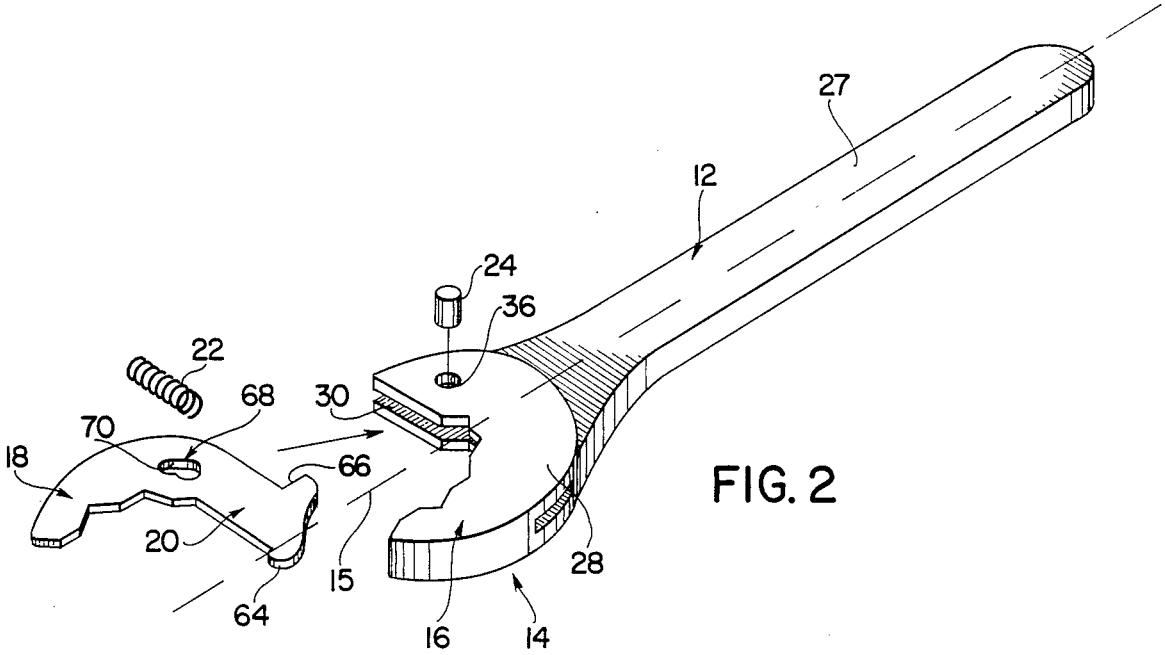
FIG. 2 is an exploded perspective view thereof.
Figure 3:
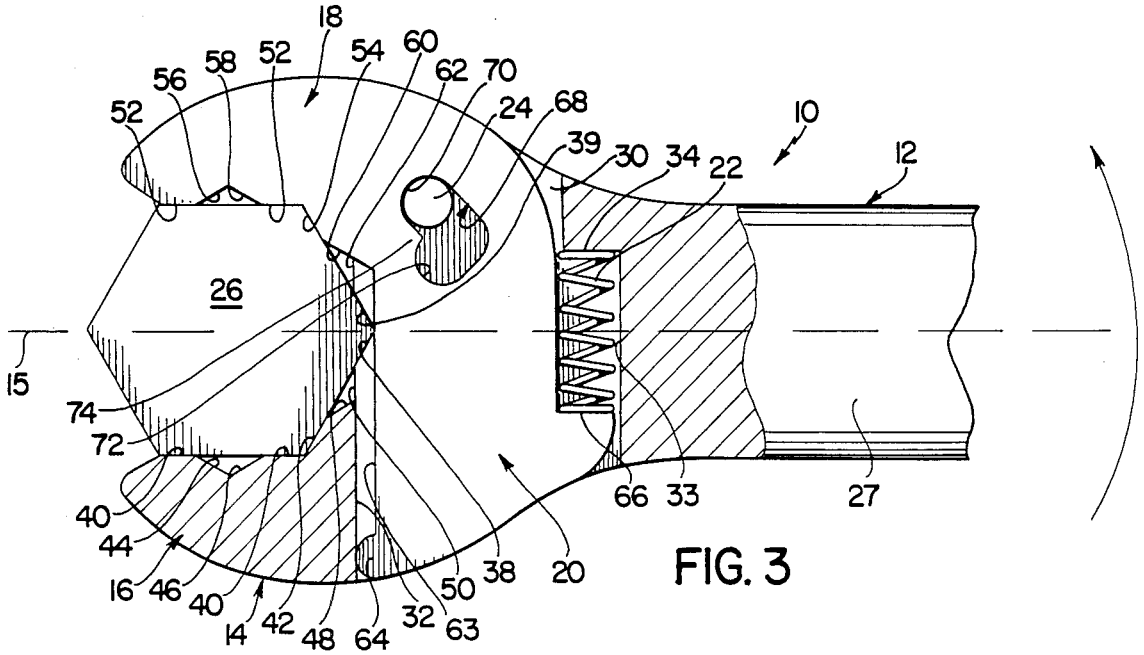
FIGS. 3 and 4 are enlarged fragmentary sectional views illustrating the operation of the wrench.
Figure 4:
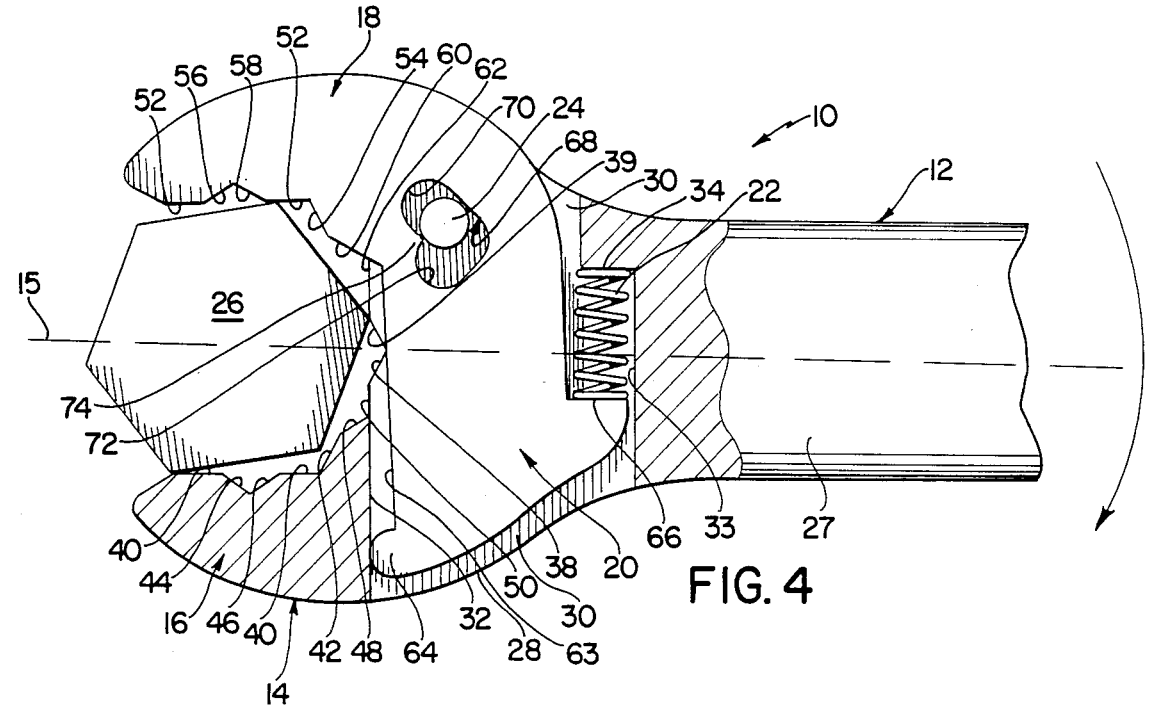

Referring now to the drawings, the wrench of the instant invention is illustrated and generally indicated at 10 in FIGS. 1 through 4. The wrench 10 comprises a handle element generally indicated at 12 and a jaw assembly generally indicated at 14 on the handle element 12. The jaw assembly 14 has an axis or centerline 15, and it comprises a first jaw portion generally indicated at 16, a second jaw portion generally indicated at 18, a slide portion generally indicated at 20, a biasing spring 22, and a pin element 24. As illustrated in FIGS. 3 and 4, the wrench 10 is receivable on the head of a fastening element 26, and it is operative with an automatic ratchet action for rotating the fastening element 26, in a manner which will hereinafter be more fully set forth.

The handle element 12 is preferably made from a suitable metal, such as steel, in an elongated configuration, and it includes a main portion 27 and an enlarged end portion 28. The first jaw portion 16 is integrally formed with the enlarged end portion 28, and an open interior trackway or passage 30 extends transversely through the composite structure comprising the enlarged end portion 28 and the first jaw portion 16. As illustrated in FIGS. 3 and 4, the trackway 30 passes through the first jaw portion 16, and the outer edge of the portion of the trackway 30 which passes through the first jaw portion 16 is defined by a stop wall 32 which extends in substantially perpendicular relation to the axis 15, and a notch 33 including shoulder 34 which extends in a direction substantially parallel to the axis 15 is formed along the inner edge of the trackway 30 in the area where the enlarged end portion 28 merges with the remainder of the handle element 12. Formed in the enlarged end portion 28 on the opposite side of the axis 15 from the first jaw portion 16 is a bore 36 which extends from one side of the enlarged end portion 28 into the trackway 30 and then through to the opposite side of the end portion 28, and the pin 24 is secured in the bore 36. An outwardly facing notch having faces 38 and 39 which are disposed at angles of approximately 120° with respect to each other is formed along the axis 15 in the central portion of the enlarged end portion 28.

The first jaw portion 16 is integrally formed with the enlarged end portion 28, and it includes a bifurcated first primary face 40 which is substantially parallel to the axis 15 and a second primary face 42 which is disposed at an angle of approximately 120° to the first primary face 40 and substantially aligned with the face 38 in the end portion 28. A pair of secondary faces 44 and 46 which are disposed at angles of approximately 120° to each other define a V-shaped notch in the first primary face 40, and a similar notch is defined by a pair of secondary faces 48 and 50 between the primary faces 42 and 38.

The second jaw portion 18 is integrally formed with the slide portion 20 from a suitable metal, such as steel, so that the second jaw portion 18 extends in substantially perpendicular relation to the slide portion 20. The slide portion 20 is of generally elongated configuration, and the slide portion 20 and the second jaw portion 18 are mounted on the enlarged portion 28 of the handle element 12 so that the second jaw portion 18 is normally maintained in a normal position illustrated in FIGS. 1 and 3 wherein the second jaw portion 18 cooperates with the first jaw portion 16 to define a mouth for receiving the head of the fastening element 26. The second jaw portion 18 includes a bifurcated first primary face 52 which is substantially parallel to the axis 15 and to the first primary face 40 on the first jaw portion 16 when the second jaw portion 18 is in the normal position thereof. The second jaw portion 18 also includes a second primary face 54 which is disposed at an angle of approximately 120° with respect to the first primary face 52 and substantially aligned with the face 39 when the second jaw portion 18 is in the normal position thereof. A pair of secondary faces 56 and 58 which are disposed at an angle of approximately 120° with respect to each other define a V-shaped notch in the first primary face 52, and a pair of secondary faces 60 and 62 define a similar notch between the second primary face 54 and the face 39.

As illustrated in FIGS. 3 and 4, the slide portion 20 is slidably received in the trackway 30, and it includes a forward surface 63 having a stop 64 thereon which is disposed adjacent the opposite end of the slide portion 20 from the second jaw portion 18 and positioned so that is engageable with the stop wall 32. A spring shoulder 66 is formed in the slide portion 20 so that it is substantially parallel to and faces the shoulder 34 when the slide portion 20 and the second jaw portion 18 are in the normal positions thereof. An aperture 68 is formed in the slide portion 20 on the same side of the axis 15 as the second jaw portion 18. The aperture 68 includes an elongated, generally oval-shaped main portion 70 which extends generally angularly outwardly relative to the axis 15 and the first jaw portion 16 toward the second jaw portion 18, and a secondary portion 72 which extends generally angularly toward the axis 15 from the innermost portion of the oval-shaped main portion 70 and cooperates with the main portion 70 to define a ridge 74. The main portion 70 of the aperture 68 defines a track for the pin element 24 in order to restrict and guide the movement of the slide portion 20 and the second jaw portion 18 as will hereinafter be more fully set forth.

The spring 22 is received in the jaw assembly 14 so that it is interposed between the shoulders 34 and 66, and the pin 24 is received in the bore 36 that it extends through the aperture 68. Accordingly, the spring 22 biases the slide portion 20 and the second jaw portion 18 generally toward the first jaw portion 16. Further, because the spring 22 is operative for applying a biasing force along an axis which is spaced from both the axis of the pin element 24 and the stop wall 32, the spring 22 also applies a pivoting force to the slide portion 20 and the second jaw portion 18 which biases the second jaw portion 18 in the general direction of the adjacent end of the handle element 12. However, the pin element 24 is engageable with the perimeter of the main portion 70 of the aperture 68 adjacent the outer end of the main portion 70 for preventing inward movement of the second jaw portion 18 beyond the normal position thereof both in a direction toward the adjacent end of the handle element 12 and in a direction toward the first jaw portion 16. Still further, the main portion 70 of the aperture 68 is formed so that it defines a seat at the outer end thereof, and so that as long as the pin element 24 is received in engagement with the seat at the outer end of the main portion 70, the pin element 24 and the stop wall 32 cooperate to prevent the second jaw portion 18 from being moved outwardly away from the first jaw portion 16 beyond the normal position of the second jaw portion 18. Accordingly, as long as the sum of the forces applied to the second jaw portion 18 and the slide portion 20 (including the forces applied thereto by the spring 22) have a net component which extends toward the adjacent end of the handle element 12 so that the pin element 24 is maintained in engagement with the seat at the outer end of the main portion 70 of the aperture 68, the second jaw portion 18 cannot be moved outwardly and away from the first jaw portion 16. However, when the sum of the forces applied to the slide portion 20 and the second jaw portion 18 has a net component which extends outwardly and away from the adjacent end of the handle element 12, the pin 24 is disengaged from the seat in the main portion 70 of the aperture 68 to permit the second jaw portion 18 to be moved in a direction which is generally outwardly and away from the adjacent end of the handle element 12 and the first jaw portion 16.

As illustrated in FIGS. 3 and 4, the manner in which the second jaw portion 18 and the slide member 20 are mounted on the handle element 12 so that they are capable of restricted movement when the sum of the forces applied to the second jaw portion 18 and the slide portion 20 has a net component which extends outwardly and away from the adjacent end of the handle element 12 enables the wrench 10 to be operative with an automatic ratcheting action for manipulating the head of the fastening element 26. In this connection, as illustrated in FIG. 3, when the wrench 10 is assembled on the head of the fastening element 26 in the manner illustrated and a force is applied to the wrench 10 to rotate the fastening element 26 in a counterclockwise direction, the head of the fastening element 26 applies a force to the first primary face 52 which tends to urge the second jaw portion 18 away from the first jaw portion 16 and also to pivot the composite structure comprising the slide portion 20 and the second jaw portion 18 about the stop member 64 so that the second jaw portion 18 is also urged toward the adjacent end of the handle element 12. As a result, the pin 24 is forced against the seat at the outer end of the main portion 70 of the aperture 68 to prevent the second jaw portion 18 from separating from the first jaw portion 16. In addition, the head of the fastening element 26 applies a force to the second primary face 54 which further urges the second jaw portion 18 toward the adjacent end of the handle element 12 so that the pin element 24 is further urged into engagement with the seat in the main portion 70 of the aperture 68. As a result, when a force is applied to the wrench 10 to turn the head of the fastening element 26 in a counterclockwise direction, the second jaw portion 18 is effectively retained in the normal position thereof so that a rotating force can be applied to the fastening element 26. A similar effect is achieved when the wrench is positioned on the head of the fastening element 26 so that the head of the fastening element 26 is received in engagement in the notches defined by the secondary faces 44, 46, 48, 50, 56, 58, 60, and 62, and obviously a similar effect is achieved when the wrench 10 is turned over so that the opposite side thereof faces upwardly and a force is applied to the wrench to rotate the fastening element 26 in a clockwise direction.

On the other hand, as illustrated in FIG. 4, when the wrench 10 is assembled on the head of the fastening element 26 in the manner illustrated and a force is applied to the wrench 10 to rotate the head of the fastening element 26 in a clockwise direction, the second jaw portion 18 is moved outwardly from the first jaw portion 16 against the force of the biasing spring 22 to enable the head of the fastening element 26 to rotate between the first and second jaw portions 16 and 18, respectively. In this connection, as illustrated in FIG. 4, when the wrench 10 is manipulated to rotate the head of the fastening element 26 in a clockwise direction, the head of the fastening element 26 applies a force to the face 52 having a direction which tends to move the slide portion 20 and the second jaw portion 18 both outwardly and away from the axis 15 and the adjacent end of the handle element 12. As a result, once a sufficient force is applied to the second jaw portion 18 to overcome the biasing force of the spring 22, the second jaw portion 18 is moved outwardly and away from the first jaw portion 16 and the adjacent end of the handle element 12, and the pin element 24 is repositioned in the track defined by the main portion 70 of the aperture 68. Further, as soon as the second jaw portion 18 has been moved outwardly away from the first jaw portion 16 by a sufficient distance to enable the head of the fastening element 26 to rotate between the first and second jaw portions 16 and 18, the head of the fastening element 26 is repositioned between the first and second jaw portions 16 and 18 so that it engages the secondary faces 44, 46, 48, 50, 56, 58, 60 and 62. As soon as this occurs, the second jaw portion 18 and the slide portion 20 are returned to the normal positions thereof by the spring 22. However, as a force is applied to the handle element 12 to further rotate the head of the fastening element 26 in a clockwise direction, the second jaw portion 18 is again moved outwardly and away from the first jaw portion 16, and the head of the fastening element 26 is repositioned in engagement with the primary faces 40, 42, 52, and 54. In other words, as a continuous force is applied to the wrench 10 to rotate the head of the fastening element 26 in a clockwise direction, the head of the fastening element 26 rotates with a ratcheting action in the jaw assembly 14. A similar effect is achieved when the wrench 10 is turned over so that the opposite side thereof faces upwardly, and then manipulated to rotate the head of a fastening element 26 in counterclockwise direction. Further, the wrench 10 can be retained in an open or inoperative position by moving the second jaw portion 18 outwardly so that the pin element 24 passes over the ridge 74 and is received in the secondary portion 72 of the aperture 68.

It is seen, therefore, that the instant invention provides an effective open-end wrench which is operative with an automatic ratcheting action. The wrench 10 can be alternatively assembled on the head of a fastening element 26 for applying either a counterclockwise or a clockwise rotating force thereto; and in either case, when the wrench 10 is manipulated to rotate the head of the fastening element 26 in the reverse direction, the head of the fastening element is rotatable in the jaw assembly 14 to effect an automatic ratcheting action. Further, because of its relatively simple construction, the wrench 10 can be effectively embodied in wrenches having substantially the same overall dimensions as conventional open-end wrenches so that it can be effectively utilized in areas with limited space or clearance. Accordingly, it is seen that the wrench of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A wrench comprising a handle element having first and second ends and a jaw assembly on the second end of said handle element, said jaw assembly including a first jaw portion on the second end of said handle element, a slide portion and a second jaw portion attached to said slide portion, said slide portion being movably attached to said handle element, said second jaw portion having a predetermined normal position wherein said first and second jaw portions cooperate to define an open mouth for receiving the head of a hex-headed fastening element and wherein the head of said fastening element is receivable in said open mouth, means movably attaching said slide portion to said handle element such that when said second jaw portion is in said normal position and when said jaw assembly is rotated to rotate the head of said fastening element in a first direction, a force applied by said fastening element head to said second jaw portion extends in the direction of the second end of said handle element and when said jaw assembly is rotated in an opposite second direction to overrun the head of said fastening element, a force applied by said fastening element head to said second jaw portion extends in a direction away from both said first jaw portion and the second end of said handle element, said slide portion having a forward surface which faces away from said second end of said handle element, said attaching means comprising restricting means comprising a pin element means on either said slide portion or said handle element, the other of said slide portion or said handle element having an aperture therein, said pin element means being received in said aperture and cooperating therewith to prevent movement of said second jaw portion beyond said normal position in a direction toward said handle element, said restricting means further comprising stop means engageable with said forward surface of said slide portion for preventing pivoting of said slide portion about said pin element means when said jaw assembly is rotated to rotate said fastening element in said first direction, said pin element means being movable in said aperture to permit said second jaw portion to be moved in a direction away from both said first jaw portion and the second end of said handle element when said jaw assembly is rotated to rotate said fastening element in said second direction and means resiliently biasing said slide portion to a position wherein said second jaw portion is in the normal porition thereof.

2. In the wrench of claim 1, said first jaw portion having a face thereon, said second jaw portion having a face thereon, said second jaw portion face being substantially parallel to said first jaw portion face when said second jaw portion is in said normal position, said first and second jaw portion faces being engageable with opposite peripheral portions of the head of said fastening element to cause said second jaw portion to be cammed outwardly away from said first jaw portion and the adjacent end of said handle element when said jaw assembly is rotated said second direction, said jaw portion faces being engageable with opposite peripheral portions of said fastening element to cause said second jaw portion to be urged outwardly away from said first jaw portion and toward the second end of said handle element when said jaw assembly is rotated in said first direction.

3. In the wrench of claim 1, said aperture defining a seat at one end thereof said pin element means being urged against said seat when a force is applied to said second jaw portion having a component extending in the direction of the second end of said handle element.

4. In the wrench of claim 3, said biasing means biasing said slide portion to a position wherein said pin element means is received in said seat.

5. In the wrench of claim 4, said biasing means comprising a spring element operative along an axis which is substantially perpendicular to said jaw assembly axis, said spring element axis being spaced from said stop means, said spring element cooperating with said stop means to pivot said slide portion so that said second jaw portion is biased toward the second end of said handle element and so that said pin element is biased toward said seat.

6. In the wrench of claim 1, said first jaw portion having first and second primary faces thereon, said second jaw portion having third and fourth primary faces thereon, said first, second, third and fourth primary faces being sequentially disposed at angles of approximately 120° with respect to each other and being engageable with first, second, third and fourth corresponding sequential sides of said fastening element head.

7. In the wrench of claim 1, said first and second jaw portions having spaced substantially parallel primary faces thereon, said first jaw portion having a pair of secondary faces thereon which are disposed at angles of approximately 120° with respect to each other and approximately 210° with respect to said primary face on said first jaw portion, said pair of secondary faces on said first jaw portion defining a V-shaped notch in said primary face on said first jaw portion, said second jaw portion having a pair of secondary faces thereon which are disposed at angles of approximately 120° with respect to each other and approximately 210° with respect to said primary face on said second jaw portion, said pair of secondary faces on said second jaw portion defining a V-shaped notch in said primary face on said second jaw portion, said fastening element head passing from engagement with said primary faces to engagement with said secondary faces when said wrench is initially positioned so that said primary faces are in engagement with said fastening element head and said wrench is rotated in said second direction but remaining in engagement with said primary faces when said wrench is alternatively rotated in said first direction.

8. In the wrench of claim 7, said fastening element head passing from engagement with said secondary faces to engagement with said primary faces when said wrench is initially positioned so that said secondary faces are in engagement with said fastening element head and said wrench is rotated in said second direction but remaining in engagement with said secondary faces when said wrench is alternatively rotated in said first direction.

9. In the wrench of claim 1, said aperture including an elongated main portion which is elongated in a direction which extends generally angularly outwardly and away from said axis and the adjacent end of said handle element.

10. In the wrench of claim 9, said aperture being formed in said slide portion.

* * * * *

UNITED STATES PATENT AND TRADEMARK OFFICE

CERTIFICATE OF CORRECTION

PATENT NO. : 4,848,193

DATED : 07/18/89

INVENTOR(S) : WYLIE, Albert A., III

It is certified that error appears in the above-identified patent and that said Letters Patent is hereby corrected as shown below:

On the title page item [54] and column 1, line 2, the title should read --OPEN-END RATCHET WRENCH--.

Signed and Sealed this

Twenty-first Day of April, 1992

*Attest:*

HARRY F. MANBECK, JR.

*Attesting Officer*

*Commissioner of Patents and Trademarks*